US010138693B2

(12) United States Patent
Leuchtenberg

(10) Patent No.: US 10,138,693 B2
(45) Date of Patent: Nov. 27, 2018

(54) METHOD OF DRILLING A SUBTERRANEAN BOREHOLE

(71) Applicant: MANAGED PRESSURE OPERATIONS PTE. LTD., Harbour Front Centre (SG)

(72) Inventor: Christian Leuchtenberg, Harbour Front Centre (SG)

(73) Assignee: MANAGED PRESSURE OPERATIONS PTE LTD, Singapore (SG)

( * ) Notice: Subject to any disclaimer, the term of this patent is extended or adjusted under 35 U.S.C. 154(b) by 935 days.

(21) Appl. No.: 14/398,617

(22) PCT Filed: May 3, 2013

(86) PCT No.: PCT/EP2013/059314
§ 371 (c)(1),
(2) Date: Nov. 3, 2014

(87) PCT Pub. No.: WO2013/164478
PCT Pub. Date: Nov. 7, 2013

(65) Prior Publication Data

US 2015/0107898 A1 Apr. 23, 2015

(30) Foreign Application Priority Data

May 3, 2012 (GB) ..... 1207769.9

(51) Int. Cl.
*E21B 21/08* (2006.01)
*E21B 47/10* (2012.01)
(Continued)

(52) U.S. Cl.
CPC ..... *E21B 21/08* (2013.01); *E21B 21/106* (2013.01); *E21B 44/00* (2013.01); *E21B 47/06* (2013.01); *E21B 47/101* (2013.01)

(58) Field of Classification Search
CPC ..... E21B 21/08; E21B 21/10; E21B 21/106; E21B 44/00; E21B 47/101; E21B 47/06
See application file for complete search history.

(56) References Cited

U.S. PATENT DOCUMENTS 5,592,438 A * 1/1997 Rorden ..... E21B 47/101 340/854.3
8,146,657 B1 * 4/2012 Gibbs ..... E21B 47/10 166/250.03

(Continued)

FOREIGN PATENT DOCUMENTS

WO WO 2011/033001 A1 3/2011

OTHER PUBLICATIONS

J.J. Xiao et al: "Modeling and Analyzing Pressure Buildup Data Affected by Phase Redistribution in the Wellbore", SPE Advanced Technology Series, vol. 4, No. 01, (May 1, 1996), XP055122359, pp. 28-37.

*Primary Examiner* — Waseem Moorad
*Assistant Examiner* — Christopher J Sebesta
(74) *Attorney, Agent, or Firm* — Norman B. Thot

(57) ABSTRACT

A method of drilling a subterranean wellbore using a drill string comprising the steps of: a. injecting a drilling fluid into the well bore via the drill string and removing said drilling fluid from an annular space around the drill string (the annulus) via an annulus return line, b. oscillating the pressure of the fluid in the annulus, c. determining the wellbore storage volume and wellbore storage coefficient for each fluid pressure oscillation, d. using the wellbore storage volume and wellbore storage coefficient to determine the proportion by volume of gas and proportion by volume of liquid in the annulus during that pressure oscillation.

11 Claims, 4 Drawing Sheets

Figure 1:
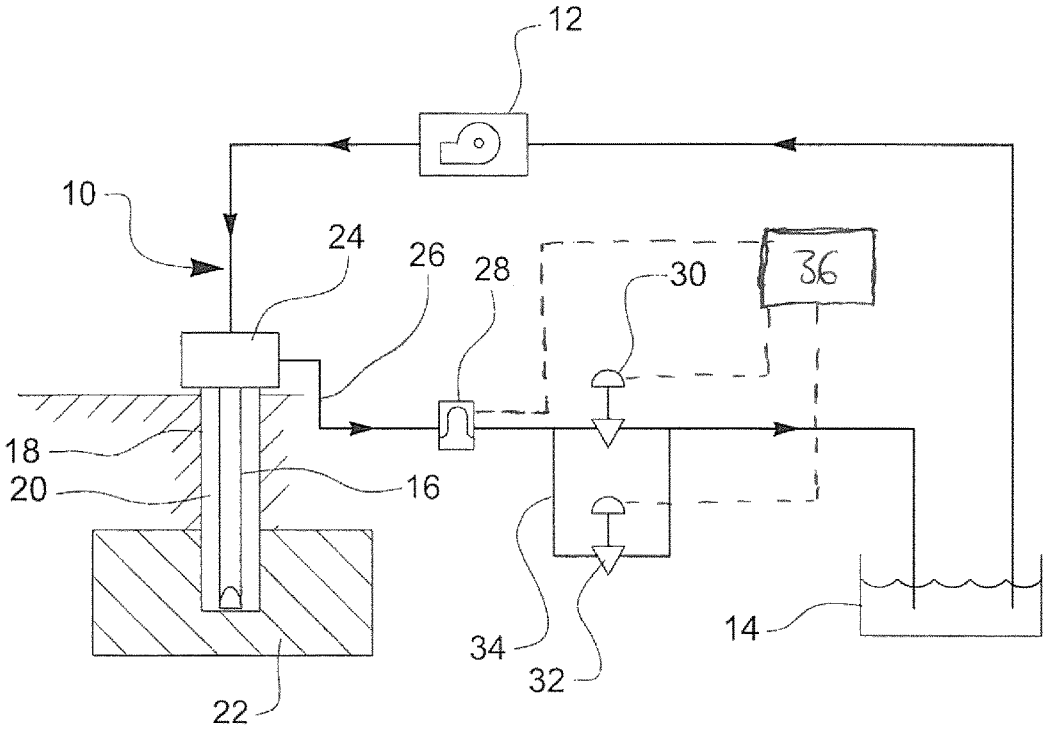

(51) Int. Cl.

| | |
|---|---|
| ***E21B 21/10*** | (2006.01) |
| ***E21B 44/00*** | (2006.01) |
| ***E21B 47/06*** | (2012.01) |

(56) References Cited

U.S. PATENT DOCUMENTS

| | | | | |
|---|---|---|---|---|
| 2003/0168258 | A1* | 9/2003 | Koederitz ..... | E21B 21/08<br>175/38 |
| 2006/0016592 | A1 | 1/2006 | Wu | |
| 2008/0210470 | A1* | 9/2008 | Stewart ..... | E21B 47/06<br>175/48 |
| 2009/0194330 | A1* | 8/2009 | Gray ..... | E21B 21/00<br>175/24 |
| 2009/0242817 | A1* | 10/2009 | Strazhgorodskiy ..... | E21B 19/16<br>251/315.16 |
| 2011/0042076 | A1* | 2/2011 | Reitsma ..... | E21B 21/08<br>166/250.01 |
| 2011/0067923 | A1* | 3/2011 | Leuchtenberg ..... | E21B 21/08<br>175/57 |

* cited by examiner

METHOD OF DRILLING A SUBTERRANEAN BOREHOLE

DESCRIPTION OF INVENTION

The present invention relates to a method of drilling a subterranean borehole, particularly, but not exclusively for oil and/or gas production.

Subterranean drilling typically involves rotating a drill bit from surface or on a downhole motor at the remote end of a tubular drill string. It involves pumping a fluid down the inside of the tubular drillstring, through the drill bit, and circulating this fluid continuously back to surface up the drilled space between the hole/tubular, referred to as the annulus. This pumping mechanism is provided by positive displacement pumps that are connected to a manifold which connects to the drillstring. The bit penetrates its way through layers of underground formations until it reaches target prospects—rocks which contain hydrocarbons at a given temperature and pressure. These hydrocarbons are contained within the pore space of the rock (i.e. the void space) and can contain water, oil, and gas constituents—referred to as reservoirs. Identifying, penetrating, and placing the drilled hole in these existing reservoirs is the entire purpose for drilling these wellbores. Due to overburden forces from layers of rock above, these reservoir fluids are contained and trapped within the pore space at a known or unknown pressure.

At the bottom of the tubular drillstring, downhole measuring devices are integrated into the drillstring above the downhole motor and bit. This allows the drilled hole to be steered in the appropriate direction to reach the reservoir target. Two parameters measured downhole for the purpose of this patent and its methodology are the bottom hole pressure (BHP) and bottom hole temperature (BHT). BHP is the pressure at the bottom of the drilled hole created by the hydrostatic pressure of the drilling mud, applied pressure at surface, and frictional pressure losses created in the entire profile of the drilled hole annulus. The temperature is the average temperature at the bottom of the hole given the mud temperature and the surrounding formations and their geothermal gradients. These values are transmitted to the surface via a pulse in the internal drillstring volume that is decoded with computer algorithms.

A fluid of a given density/weight fills the annulus of the drilled hole. The purpose of this drilling fluid or drilling mud is to lubricate, carry drilled rock cuttings to surface, cool the drill bit, and power the downhole motor and other tools. Mud is a very broad term and in this context it is used to describe any fluid or fluid mixture that covers a broad spectrum from air, nitrogen, misted fluids in air or nitrogen, foamed fluids with air or nitrogen, aerated or nitrified fluids, to heavily weighted mixtures of oil and water with solids particles. Most importantly this fluid and its resulting hydrostatic pressure—the pressure that this column of fluid exerts at the bottom from its given weight and vertical height of the column—prevent the reservoir fluids at their existing pressure from entering the drilled annulus.

During times of circulating and non-circulating it is critical that this pressure at the bottom of the hole where the reservoir exists is always greater than the reservoir pressure. These balanced or overbalanced conditions are required for safety during any drilling operation outside of underbalanced drilling methods which allows the reservoir fluids to enter the annulus while drilling—but with equipment in place at surface to safely control this using closed loop ideology. Therefore, outside of the underbalanced case, the drilling fluid always creates an equal or larger bottom hole pressure value at the reservoir interface than the reservoir pressure that exists. This is accomplished by either increasing the density of the drilling fluid, or creating a closed loop system where pressure can be applied at surface to add pressure at the bottom of the drilled hole.

The latter can be referred to as Managed Pressure Drilling (MPD). MPD uses a device that seals around the tubular drillstring at surface, referred to as a rotating head, which diverts flow via a pipe conduit to a choking mechanism known as a choke or control valve. By opening or closing this choke or control valve, the flowing return stream will increase or decrease in pressure, which will increase or decrease pressure at the drilled hole/reservoir interface to maintain a pressure in the wellbore at this interface greater than the value of the reservoir pressure.

It is when this bottom hole pressure at the reservoir interface in the drilled annulus decreases to below the reservoir pressure that one of the most dangerous events while drilling can occur, which is referred to as a kick. A kick, or influx, is when undesired formation fluid at its higher pressure enters into the drilled annulus. Normally, this fluid that enters the annulus commonly contains gas as one of its constituents. As this influx rises in the annulus, it expands due its lighter weight and presence of gas contained within the fluid, referred to as gas dissolved in solution. This condition carries high risk when it reaches surface due to the expansive nature of gas and the explosive nature of hydrocarbons. If this influx reaches surface in an uncontrolled manner it could result in a major release, referred to as a blow out, which can result in injury, death, and equipment and environmental damage, and the high cost associated with these.

While drilling conventionally, i.e. in a system that is open to atmosphere, when a kick enters the annulus the procedure is to close the safety mechanism that seals around the pipe to prevent any fluid or gas from escaping the annulus, referred to as a Blow Out Preventer (BOP). All annulus fluid is routed to a closed choke valve via a pipe conduit known as the choke line. This involves stopping drilling operations and can result in hours or days spent removing the influx from the well.

While drilling with MPD systems, a closed loop system already exists where all flow is routed via a flow line to a choke valve. This is possible by installing a rotating head device at surface, which seals around the tubular at surface. When a kick or influx enters the wellbore with this system, depending on the volume of the influx, drilling may continue while it is circulated through the MPD system and removed safely. If the volume is significant, drilling will cease and the same condition occurs here as with conventional methods—the BOP is closed, and hours or days can be spent removing the influx from the well.

In both scenarios, once the influx is in the annulus, the focus moves to the choke operation and its effects on the BHP. The operation of the choke valve is a function of the rate of circulation, circulation pressure, return stream composition and rate, and pressures at the bottom of the hole (BHP) and at the choke. All of these variables are involved for safely removing the influx from the annulus using a pre-calculated pressure versus volume schedule applied to several different conventional methods for removing it from the annulus.

There are many methodical approaches that are currently used to circulate kicks out of the annulus, referred to as well kill operations, and all involve manual choke adjustment and estimated calculations for determining the volume of the kick, how it behaves as it migrates up the annulus, and its corresponding maximum expected surface pressures to ensure that it can safely be removed with the systems and equipment in place—i.e. the well and pressure control equipment operating limits and specifications are not exceeded. There are also commercial software models that can predict the influx behaviour as it moves up the annulus which accurately correct for the temperature and solubility effects on the influx, but with no link to a real time automated choke manipulation. In deep wells with high pressure and high temperatures (HPHT wells), the behaviour of gas in the annulus can be unpredictable due to gas in solution effects with changing temperature and pressure along the length of the drilled hole. Therefore this can cause manual choke position adjustments based on hand calculated pressure schedules to be non-reactive or over-reactive to what is actually occurring in the annulus as the gas/influx rises and expands—a resultant inaccurate response and method to control the influx which can lead to well instability. Regardless, the main objective of the well kill operation is to maintain a constant bottom hole pressure—and one which is higher than the reservoir pressure while the gas is circulated completely out of the well. This is to prevent further influx occurring from the reservoir into the drilled annulus.

The general relationship for predicting the behaviour of the influx in the annulus for conventional well kill operations is called Boyle's law. Some error is introduced immediately as the calculations done for well kill do not take into account changing temperature along the profile, which becomes even more critical in HPHPT wells. There can be a high degree of uncertainty where the gas will reach its bubble point, referred to as the pressure where the first gas begins to separate from the influx fluid, and start to break out of solution. This is the point in the circulation procedure where the effects of gas expansion are observed, and is a critical point in the wellbore and well control procedure during an influx sequence.

If the influx contains a large volume of water or oil, that this may be detected as soon as the influx enters the annulus. If the influx is made up predominantly of gas, generally, it is only at the bubble point pressure where an influx is detected at surface, as it is at this point that gas expansion begins and fluid volume is displaced from the annulus as a result and measured at surface. Hence at surface there is an increase in measured flow rate out of the well compared to the measured flow rate into the well, which is the indicator influx is in the wellbore. From this point, the compressibility of the wellbore volume begins to increase as the volume of gas increases from expansion as it migrates to surface. More importantly, the bubble point pressure can occur at shallow depths due to gas solubility in oil based drilling fluids leading to less reaction time (i.e. less of a safety margin) to secure the well at surface with the BOP.

The compressibility of the annulus is the change in volume as a result of a change in pressure. The compressibility of the annular volume will change given the fluids, solids, and gas volumes that comprise the volume. When the annular volume is full of liquid (i.e. does not contain a gas influx) it is relatively incompressible, and requires a large increase in pressure to achieve even the smallest change in volume. When a gas influx is present, the compressibility of the annular volume increases as the fluid is displaced from an expanding volume of gas—as the gas volume increases, the compressibility of the system increases accordingly. In this case, a large change in pressure achieves a large change in volume. Therefore, the calculated compressibility of the annular volume is directly related to the volume of gas and fluid present at the time it is measured.

The dynamic gain or gain setting ($G_{choke}$) of a choke or control valve is the derivative or slope of the choke's flow characteristic, or more simply, the time taken to achieve a given change in flow rate through the choke. The gain setting therefore represents the responsiveness of the valve, i.e. its response (slower versus rapid) in achieving the choke position to obtain the desired flow rate once the open/close signal is transmitted. Undesired changes in the gain parameters with respect to the valve opening/closing can cause the system being controlled to become nonresponsive or unstable from over/undercompensated movement of the valve. The gain is an adjustable variable for the choke or control valve.

The deadband of a choke or control valve is a quantitative indication of how much a choke's actual position deviates from the desired position when it changes direction—i.e. when the choke changes direction, how far it will travel before it starts to change the flow rate. It is defined using a standardized test procedure, and in general it measures the friction and "looseness" that exists in a choke's drive train. Whenever a change in direction is required for adjusting flow, it will always pass through its deadband range first before any change in flow rate starts to occur. The deadband is a valve characteristic and is valve specific, therefore it is a constant that cannot be adjusted.

When gas is flowing through the choke, the choke should be adjusted to higher values of gain setting $G_{choke}$ to make the valve more responsive—small create large changes in flow rate due to the pressure drop across the choke and the resulting gas expansion. Increasing the gain value will increase the reactivity of the valve to reach the valve position to achieve the desired flow rate change. For example, due to increased compressibility of the system from increased gas volume, it will take a larger change in pressure to achieve the change in flow rate, equating to a larger change in valve position. To compensate for this, the valve gain setting is increased in value. With fluid, gain value should be less, as small changes in the choke position have a more direct impact on the liquid flow due to less compressibility—so a less responsive valve would be desired. The choke operation and its gain setting in these circulating situations when influx is present is normally manually controlled by an operator, and therefore human error is introduced in keeping pressures constant while the compressibility and volume fractions (gas and liquid) of the system continuously changes with time. As the influx moves closer to surface increases in surface pressure and volume flow rate changes are occurring more rapidly. In order to keep pressures constant, valve position changes need to be more responsive and therefore the gain setting needs to increase for the valve.

In the initial phases of circulating out a kick, adjustments to the choke position are periodic and less frequent as most of the volume in the annulus is fluid with low compressibility—i.e. a low gain setting is present on the choke control, and the gas is deep in the well and compressed within the system with flow through the choke being all fluid and no gas. As the gas circulates higher up the annulus and to the surface, choke adjustments become more frequent and more rapid to compensate for the expansion of the gas—i.e. the gain setting will need to increase as flow increases considerably with a small adjustment on the choke. With these conditions, compressibility of the annular volume increases as gas volume expands and displaces fluid from the well—a higher level of reactivity through an increased gain setting is required to achieve the choke position and subsequent desired change in flow rate. Once the gas has been circulated out and the drilling fluid behind the influx reaches the choke, another rapid response is required as the system reverts back from a highly compressible system with gas to a more incompressible single phase system, i.e. the gain setting will need to decrease rapidly so there is not an over-reaction to achieve the choke position, as small less reactive adjustments to choke position are required to maintain stability. The fractional volume of gas at any given time in the well during these circulation periods is never accurately known with any of the conventional methods or systems.

A new drilling method and system was disclosed in our co-pending patent application WO11/033001. This system will hereinafter be referred to as the Pressure Determination System (PDS). This involves inducing a pressure pulse on the annulus of the existing closed loop system, preferably by installing a smaller diameter flow line and choke that runs parallel with the existing choke in an MPD system, the smaller diameter flow line connecting to the annulus return line upstream of the larger diameter choke and reconnecting to the annulus return line downstream of the larger diameter choke. All drilling fluid from the annulus returns to the annulus flow line leading to the larger diameter choke (referred to as the MPD choke), which will control the overall bottom hole pressure. A small volume of the returned drilling fluid flow is diverted through to the smaller diameter flow line and choke, and then reconnects with the main annulus return line downstream of the MPD choke. The small choke (referred to as the PDS choke) will cycle opened and closed intermittently and create a pressure pulse in the annular volume of the drilled hole. This pressure pulse transmits from surface to the well bottom and back to surface again. Alternatively, it will be possible to generate this pulse using the main primary choke or control valve utilized in an MPD system. The electrical signal transmitted from the microprocessor to the main choke will produce the necessary valve cycle and always return the choke to the previous set points for maintaining the required BHP.

The significance of the PDS is that the transmitted pulse will react to changes in pressure and composition in the annulus. Therefore when there is an influx in the annulus, the waveform of the transmitted pulse will exhibit changes in its behaviour in regards to amplitude (or simply put, the upper and lower values that this wave/pulse is bound to). Influx is interpreted as added flow rate introduced into the annulus, flowing upwards towards surface, and the incoming pulse also has an effective flow rate travelling downwards towards the bottom of the well. These two opposing pressure/flow regimes collide and produce a new waveform with increased amplitude and/or discontinuities from attenuation in the gas phase of the influx travelling towards surface. In absence of influx, the waveform properties of the pulse will not change. The PDS takes the waveform that is generated at surface on the flow rate out metering device and the surface pressure metering device, and uses this as a reference waveform for the returning pulse. When the pulse returns to surface it generates waveform traces on these same pressure and flow rate metering devices. These are compared in a computer software model and its algorithms relate the changes in return flow rate and pressure waveforms of the original and returning pulse. The model examines the waveforms for changes in amplitude values and/or discontinuities from attenuation that may result from influx in the annulus.

According to a first aspect of the invention we provide a method of drilling a subterranean wellbore using a drill string comprising the steps of:

a. injecting a drilling fluid into the well bore via the drill string and removing said drilling fluid from an annular space around the drill string (the annulus) via an annulus return line,
b. oscillating the pressure of the fluid in the annulus,
c. determining the wellbore storage volume and wellbore storage coefficient for each fluid pressure oscillation,
d. using the wellbore storage volume and wellbore storage coefficient to determine the proportion by volume of gas and proportion by volume of liquid in the annulus during that pressure oscillation.

The wellbore storage volume and wellbore storage coefficient may be determined by monitoring the rate of flow of fluid along the annulus return line.

Alternatively, the wellbore storage volume and wellbore storage coefficient may be determined by monitoring the fluid pressure at the top of the annulus.

The volume percentage of gas in the annulus and the fluid pressure in the annulus are advantageously used to obtain an estimate of the maximum pressure of the gas when the gas enters the annulus return line.

In one embodiment of the invention, drilling is stopped and a blowout preventer closed around the drill string if it is determined that the estimated maximum pressure of the gas when the gas enters the annulus return line exceeds a predetermined value.

Based on the gas fractional volumes calculated from the wellbore storage volume and coefficients (which are based on the PDS pulse data), a decision tree is produced by the system which carries out a decision to either use the rig's well control system to deal with the influx (based on the maximum predicted surface pressure) or allow the gas to reach the surface for the MPD system to manage the influx. The predicted surface pressure from the proposed invention will determine which safety procedure to use—smaller pressures will be manageable by the MPD system if they fall within its operating limits, which saves operational rig time because the subsea blowout preventer (SSBOP) does not have to be closed and long duration well control procedures implemented as a result. The decision tree also determines when the SSBOP must be closed (including a safety factor) if the influx is to be managed with the rig well control equipment. Any uncertainty in its outputs will prompt to close the SSBOP and divert flow through the rig well control system.

In one embodiment of the invention, a main control choke is provided in the annulus return line, and the oscillation of the pressure in the annulus is achieved by oscillating the main choke so that the degree to which the choke restricts fluid flow along the annulus return line is alternately decreased and increased.

In an alternative embodiment of the invention a main control choke is provided in the annulus return line, and an auxiliary choke is provided in a branch line which extends from the annulus return line upstream of the main control choke to the annulus return line downstream of the main control choke, the oscillation of the pressure in the annulus is achieved by oscillating the auxiliary choke so that the degree to which the choke restricts fluid flow along the branch line is alternately decreased and increased.

The method may further include the steps of monitoring the fluid pressure at the bottom of the wellbore, and controlling the main choke to maintain the fluid pressure at the bottom of the wellbore at a predetermined level.

In one embodiment of the invention, the main choke is operated to increase its restriction of fluid flow along the annulus return line immediately after the presence of gas in the annulus is detected.

Where is main choke of provided, the method may further include the step of controlling the gain setting of the main choke in accordance with the proportion by volume of gas in the annulus.

In one embodiment of the invention, an estimate of the position of any gas in the annulus is determined by analysing the shift in the frequency of the returning pressure pulse compared with the frequency of the applied pressure pulse.

The important outputs of the PDS calculated from the changes in the transmitted pulse pressure and flow rate waveforms are the wellbore storage volume and wellbore storage factor, $V_{WS}$ and $C_{WS}$. The wellbore storage is the change in the annulus volume to a corresponding change in pressure, i.e. volume change for a given change in pressure. The relationship important to understand is that when the wellbore is compressed with added surface pressure the flow rate measured decreases as more fluid enters and is stored the annulus momentarily. As this surface pressure is released the system decompresses and this is seen as an increase in flow rate measured as this volume of fluid is released from the annulus.

The generated outputs from the PDS system are the change in the measured flow rate over the time duration that this change occurs, and is referred to as $V_{WS}$. Divide this by the pressure change that this event occurred over, and this yields the wellbore storage coefficient $C_{WS}$. $C_{WS}$ represents the compressibility of the total wellbore volume and is used to indicate changing compressibility of the system, i.e. such as when gas influx is present. The PDS software performs these calculations, taking into account temperature and pressure effects in the annulus, compressibility factors of the annulus constituents with their respective volume fractions of liquids and solids, and real time data obtained while drilling. The software also accounts for the continuously increasing wellbore volume as well depth increases during the drilling process so it is not misinterpreted as formation related. Any changes from previous data points causes the software to perform an investigation sequence with 3 additional pulses before confirming that there is a change at the bottom of the hole requiring an adjustment of the bottom hole pressure. An electronic signal is transmitted to the MPD choke which is adjusted accordingly relative to the BHP.

The PDS compares these output data points to previous data points generated from previous pulse transmission. The relationship of sonic transmission is directly proportional to density. As the transmission of the pulse waveform is sonic, any changes to the density or phase (liquid, solid or gas) in the annulus changes the behaviour of this waveform, and hence will be reflected within the properties of the returning waveform in the PDS system. Therefore, when a kick or influx is present in the annulus these changes in density are detected within the pulse waveform. These are observed at the return flow rate and surface pressure sensors as either amplitude changes and/or discontinuities in the returning pulse waveform at these sensors. The magnitude of the amplitude of the return flow rate waveform will initially increase when the influx enters the well, and continues to increase as the kick migrates/expands/circulates to surface. The returning pulse waveform may show discontinuity as the waveform is attenuated by the influx in the annulus, described above. The direct relationship of the calculation for wellbore storage results in continually increasing values of $V_{WS}$ and $C_{WS}$ as the influx circulates up the annulus. As the influx circulates to surface, the values increase from expansion of the gas and the resultant increase in the wellbore compressibility from higher fractional volumes of gas in the annulus as more gas breaks out of solution. Therefore, the increases in $V_{WS}$ and $C_{WS}$ are the direct indicators of the influx volume (i.e. both the fractional gas and fluid volumes) and compressibility changes in the annulus.

Figure 2:
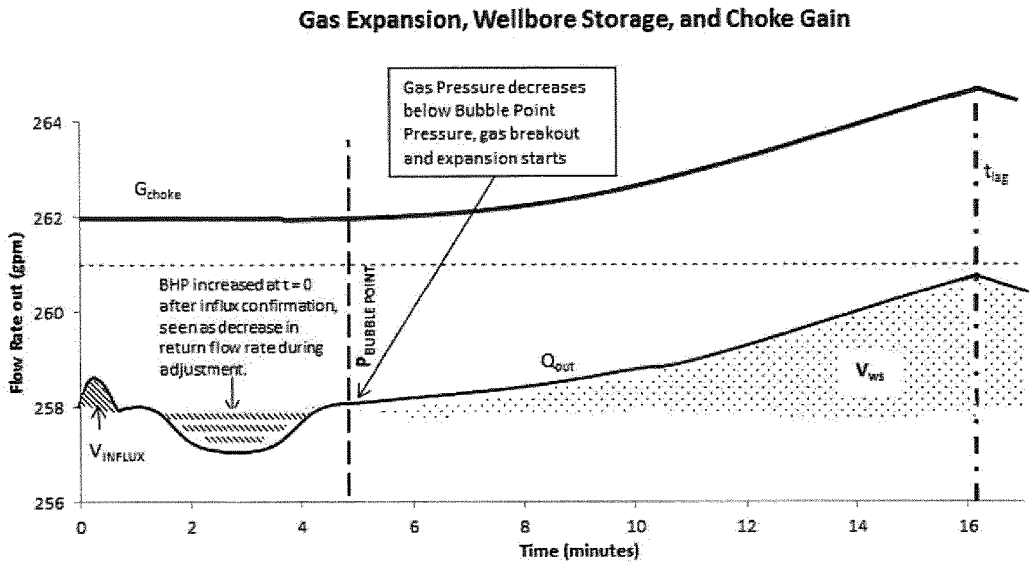
Figure 3:
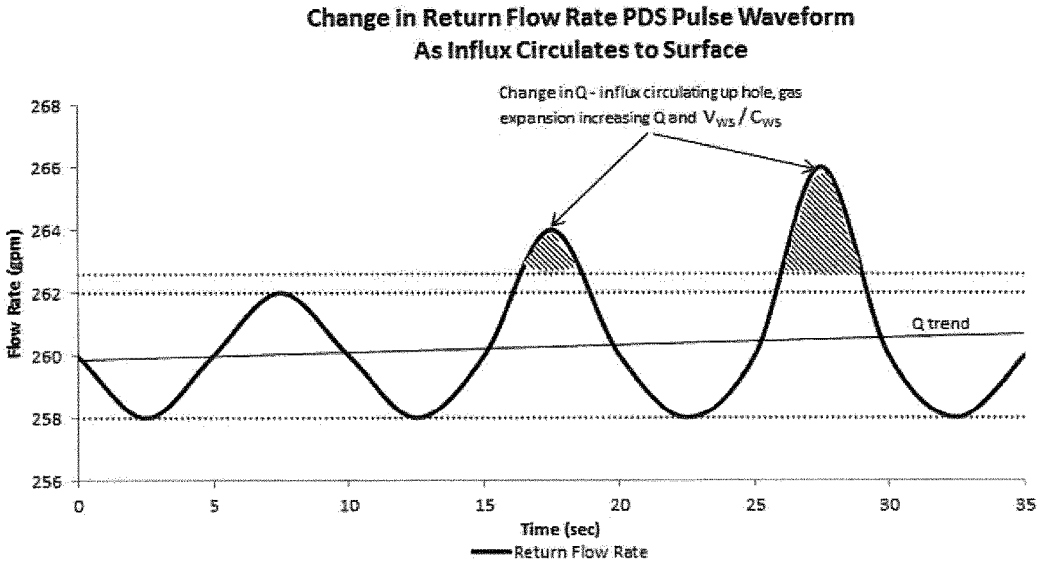
Figure 4:
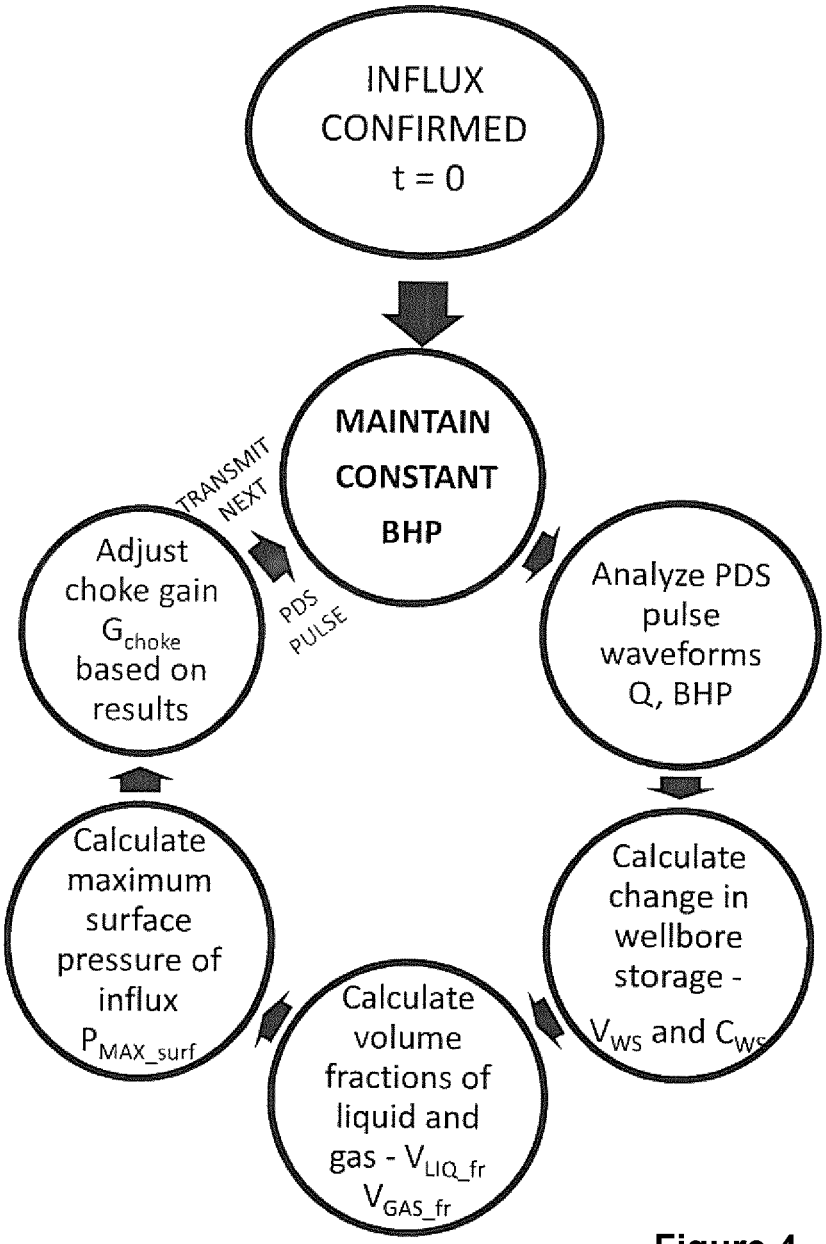
Figure 5:
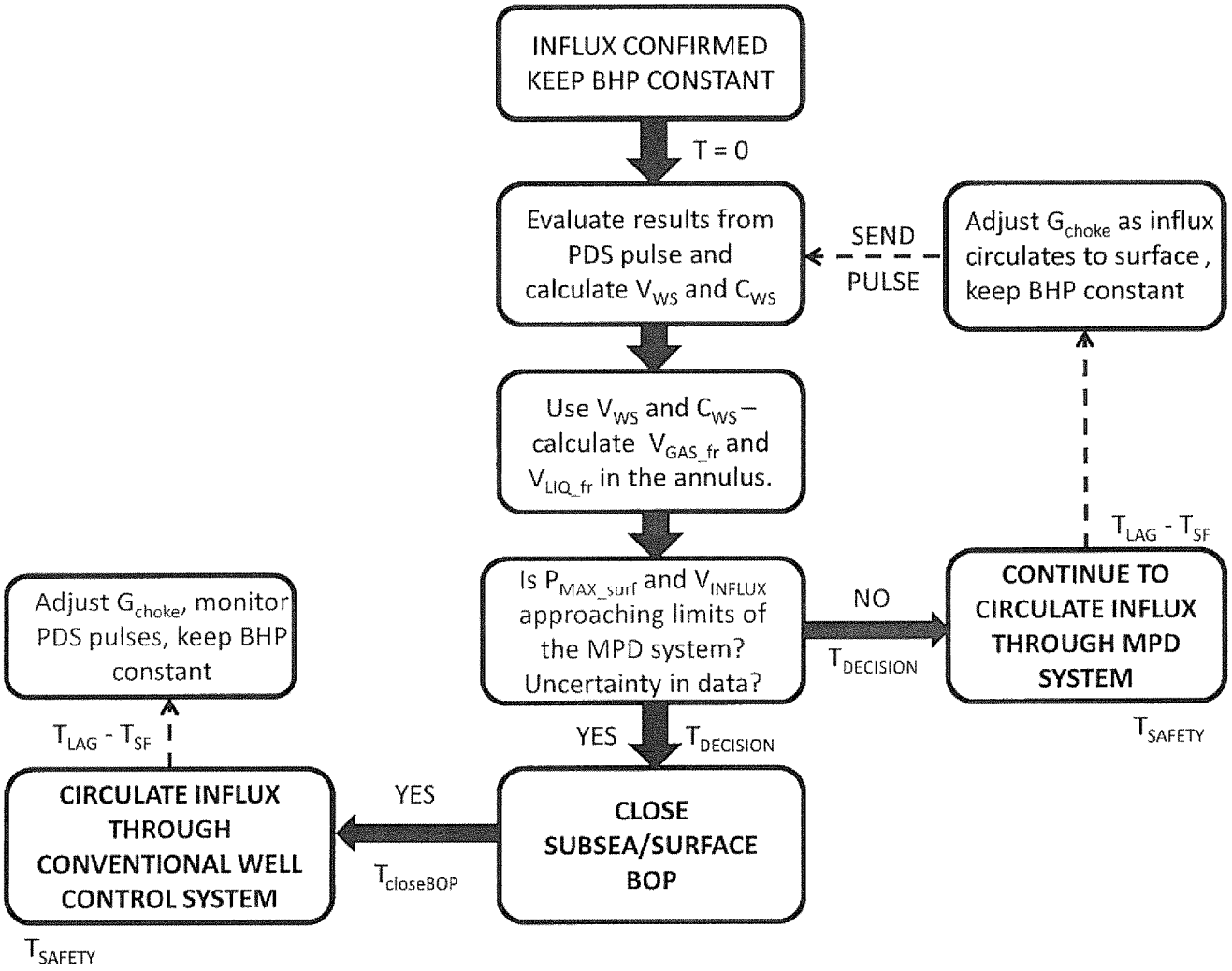

Embodiments of the invention will now be described, by way of example only, with reference to the accompanying figures, of which:

FIG. 1 shows a schematic illustration of a drilling system adapted for implementation of the drilling method according to the invention, FIG. 2 is a graphical representation of an embodiment showing the relationship between choke gain, wellbore storage, and return flow rate as the influx is circulated to surface—all in relation to the total lag time $T_{lag}$, FIG. 3 is a graphical representation of an embodiment showing the relationship between wellbore storage and return flow rate changes with respect to the PDS pulse waveform changes, FIG. 4 is a graphical illustration of the invention's processing logic in the software model, shown as a flow chart, and FIG. 5 is a graphical illustration of the invention's decision tree process for circulating the influx through the MPD system or the conventional well control system.

Referring first to FIG. 1, there is shown a schematic illustration of a drilling system 10 comprising at least one mud pump 12 which is operable to draw mud from a mud reservoir 14 and pump it into a drill string 16 via a standpipe. The drill string 16 extends into a wellbore 18, and has a drill bit at its lowermost end (not shown).

As described above, the mud injected into the drill string 16 passes from the drill bit 16*a* into the annular space in the wellbore 18 around the drill string 16 (hereinafter referred to as the annulus 20). In this example, the wellbore 18 is shown as extending into a reservoir/formation 22. A rotating control device 24 (RCD) is provided to seal the top of the annulus 20, and a flow spool is provided to direct mud in the annulus 20 to a return line 26. The RCD (24) and flow spool are installed above the BOP (not shown), which is installed on the wellhead. The return line 26 provides a conduit for flow of mud back to the mud reservoir 14 via a conventional arrangement of shakers, mud/gas separators and the like (not shown).

In the return line 26 there is a flow meter 28, typically a Coriolis flow meter which is used to measure the volume flow rate Q of fluid in the return line 26. Such flow meters are well known in the art, but shall be described briefly here for completeness. A Coriolis flow meter contains two tubes which split the fluid flowing through the meter into two halves. The tubes are vibrated at their natural frequency in an opposite direction to one another by energising and electrical drive coil. When there is fluid flowing along the tubes, the resulting inertial force from the fluid in the tubes causes the tubes to twist in the opposite direction to one another. A magnet and coil assembly, called a pick-off, is mounted on each of the tubes, and as each coil moves through the uniform magnetic field of the adjacent magnet it creates a voltage in the form of a sine wave. When there is no flow of fluid through the meter, these sine waves are in phase, but when there is fluid flow, the twisting of the tubes causes the sine waves to move out of phase. The time difference between the sine waves, $\delta T$, is proportional to the volume flow rate of the fluid flowing through the meter.

The return line 26 is also provided with a main choke 30 and an auxiliary choke 32. The main choke 30 is downstream of the flow meter 28, and is operable, either automatically or manually, to vary the degree to which flow of fluid along the return line 26 is restricted. The auxiliary choke 32 is arranged in parallel with the main choke 30, i.e. is placed in an auxiliary line 34 off the return line 26 which extends from a point between the flow meter 28 and the main choke 30 and reconnects at a point downstream of the main choke 30. In this example, the auxiliary choke 32 is movable between a fully closed position, in which flow of fluid along the auxiliary line 34 is substantially prevented, and a fully open position in which flow of fluid along the auxiliary line 34 is permitted substantially unimpeded by the choke 32. It will be appreciated that, whilst the pump 12 is pumping mud into the drill string 16 at a constant rate, operation of both the main choke 30 and the auxiliary choke 32 to restrict the rate of return of mud from the annulus effectively applies a back-pressure to the annulus 20, and increases the fluid pressure at the bottom of the wellbore 18 (the bottom hole pressure or BHP).

The auxiliary line 34 has a smaller diameter than the return line 26—in this example the auxiliary line 34 is a 2 inch line, whilst the return line 26 is a 6 inch line. As such, even when the auxiliary choke 32 is in the fully open position, a smaller proportion of the returning mud flows along the auxiliary line 34 than the return line 26, and operation of the auxiliary choke 32 cannot cause as much variation in the BHP as operation of the main choke 30. In this example, movement of the auxiliary choke 32 between the fully closed position and the fully open position causes the BHP to vary, in this example by around 10 psi (0.7 bar).

Examples of chokes particularly suitable for use in this drilling system 10 are described in more detail in application number WO11/033001.

The system is provided with various sensors which typically include pressure sensors to measure the bottom hole pressure (BHP), the pressure in the annulus 20 just below the RCD 24 (WHP), and the pressure of fluid injected into the drill string 16, temperature sensors to measure the temperature at the bottom of the well bore (BHT) and at the top of the annulus 20 just below the RCD 24 (WHT), and a further flow meter to measure to volume flow rate of fluid flowing into the drill string 16 ($Q_{in}$).

Operation of the chokes 30, 32 is controlled by an electronic control unit 36. In this example, this electronic control unit 36 is also connected to the flow meter 28, and the various other sensors, such that the electronic control unit 36 receives electronic signals representative of the volume flow rate into the annulus 20 ($Q_{in}$), volume flow rate $Q_{out}$ in the annulus return line 26, the injection pressure, the BHP, BHT, WHP, WHT and any other available real time drilling data. The electronic control unit 36 includes a microprocessor which is programmed to use a variety of algorithms to analyse the data it receives as described below.

Whilst in this example, the drilling system shown and described is a land-based system, the invention may equally be applied to off-shore drilling systems. In these cases, the RCD, annulus return line 26 and associated chokes 30, 32 etc. are provided at the top of a marine riser which extends around the drill string 16 from the well head to the drilling rig, whilst the BOP is a subsea BOP located at the wellhead on the sea bed. Where the term BOP is used in the description below, it should be understood that this could either be a surface or subsea BOP. In either case, the operating principles and fundamentals of the system do not change—they function in the same manner in both land based and offshore configurations. The main difference relevant to the invention is that in an off-shore system, the annulus 20 includes the annulus around the drill string 16 in the wellbore, and the annulus around the drill string 16 in the riser.

The drilling system is operated as follows. The pump 12 is operated to pump mud from the reservoir 14 into the drill string 16, while the drill string is rotated using conventional means (such as a rotary table or top drive) to effect drilling. Mud flows down the drill string 16 to the drill bit **16*a*, out into the wellbore 18, and up the annulus 20 to the return line 26, before returning to the reservoir 14 via the flow meter 28, chokes 30, 32, mud/gas separator and shaker (not shown). The fluid pressure at the bottom of the wellbore 18, i.e. the BHP, is equal to the sum of the hydrostatic pressure of the column of mud in the wellbore 18, the pressure induced by friction as the mud is circulated around the annulus (the equivalent circulating density or ECD), and the back-pressure on the annulus resulting from the restriction of flow along the return line 26 provided by the chokes 30, 32 (measured by the wellhead pressure or WHP). The volume flow rate of mud along the return line 26 is monitored continuously using the output from the flow meter 28**.

When the system is operated in accordance with the invention, the auxiliary choke 32 is operated to move rapidly and repeatedly between the fully open and the fully closed positions, so that the WHP and therefore also the BHP, fluctuate. In this example, the auxiliary choke 32 is operated so that the variation in WHP and BHP takes the form of a sinusoidal wave. It should be appreciated, however, that the pressure pulses may be induced on the well bore 18 as square waves, spikes or any other wave form. By altering the speed of operation of the auxiliary choke, and the extent to which it is opened each time, the frequency and amplitude of the pressure pulses can be varied to suit the geometry and depth of the well being drilled, and the formation pressure operational window of the formation 22.

The desired frequency of this "chattering" of the auxiliary choke can be calculated according to the well depth to ensure that the resulting pressure pulses reach the bottom of the wellbore 18 and return to surface for detection on the flow rate sensor 28 and WHP before the next PDS pulse is generated. For example, if the speed of sound in water is 4.4 times the speed of sound in air (i.e. 343 m/sec×4.4=1509 m/sec), and the wellbore 18 is around 6000 m deep, it can be assumed that the pressure pulses will take 4 seconds to travel the entire depth of the wellbore 18. The auxiliary choke 32 is therefore oscillated at a frequency of 5 seconds. This allows the original pulse to transmit to the well bottom and return to surface before the next pulse is generated. The frequency may, of course, be increased for shallower wellbores or decreased further for even deeper wellbores, and is generally in the range of between 2 and 10 seconds.

For example, with a 2 inch auxiliary choke, the amplitude of the fluctuation in the BHP is between for example 5 psi (0.3 bar) if the auxiliary choke 32 is opened and closed only slightly for each pulse, and 50 psi (3 bar) if the auxiliary choke 32 is opened and closed fully on each pulse. The amplitude of the fluctuations or oscillations can be set as desired for well specific conditions in a particular drilling operation.

The returned mud flow rate, in this example, as measured by the flow meter 28 and the surface pressure data WHP, are monitored by the electronic control unit 36, and used to detect a kick or gas influx, or the penetration of drilling fluid into the formation, as described in WO11/033001.

The present invention relates to how the system is operated after an influx of gas has occurred, and has been detected.

After an influx is detected and confirmed, the electronic control unit is programmed to set the time as T=0. The electronic control unit 36 then operates the main choke 30 to increase the restriction of fluid flow along the main annulus return line 26, thus increasing the BHP to above the formation pressure, so as to halt the influx. The oscillation of the auxiliary choke 32 is maintained as before, so that the pressure pulses (hereinafter referred to as PDS pulses) in the fluid in the annulus 20 continue. The system is then operated so as to maintain the new higher BHP as accurately as possible, whilst circulating the influx out of the annulus.

FIG. 2 shows the mean return flow rate $Q_{out}$ over time as the influx is circulated to surface. The volume of the influx $V_{INFLUX}$ is seen as a peak in the mean return flow rate $Q_{out}$, and the subsequent increase in BHP resulting from the operation of the main choke 30 gives rise to a decrease in the mean return flow rate $Q_{out}$. The electronic control unit is, therefore, programmed to use the flow rate data to determine the initial volume of the influx $V_{INFLUX}$.

The electronic control unit 36 then analyses the return flow rate Q and WHP for each PDS pulse, and calculates the wellbore storage volume $V_{WS}$ and wellbore storage factor $C_{WS}$ for each PDS pulse. As described on page 8 above, the wellbore storage represents the change in annulus volume for a corresponding change in pressure, and $V_{ws}$ is the change in measured flow rate over a particular time period, whilst $C_{ws}$ is obtained by dividing $V_{ws}$ by the pressure change which occurred during the same time period.

The system then utilizes these values of $V_{ws}$ and $C_{ws}$ to calculate the fractional volume of gas ($V_{GAS_fr}$) and liquid ($V_{LIQ_fr}$) in the annulus for each PDS pulse. This involves the use of complex algorithms taking into account changes in the system compressibility as the gas expands, temperature and pressure effects, and the associated changes in gas solubility as both temperature and pressure decrease up the annular profile. These types of algorithms are well known in the industry, and one example is the OLGA correlations. OLGA is a modeling tool for the flow of fluids, gases and solids within a pipe conduit (i.e. up the annulus of a wellbore), referred to as transient multiphase transport. The main challenge with multiphase fluid flow is the formation of slug flow (plugs of fluid and solids) in the pipe conduit as it flows up the wellbore. The OLGA model makes it possible to calculate the multiphase flow characteristics, such as phase velocity, phase time to reach surface, fractional volume, and pressures. It also predicts the flow behavior of the phases (gas, liquid, solids) such as the flow regime present from the entry point of the influx to the surface/exit point. This is just one transient multiphase tool that is available and is well known in drilling and production applications.

Due to the complexity of models such as OLGA and the intensity of the calculations use for transient multiphase flow, these calculations cannot easily be performed manually and the electronic control unit 36 must, therefore, include a microprocessor with sufficient computing power to carry out these calculations and to maintain their accuracy.

The electronic control unit 36 is preferably programmed to carry out this calculation for every PDS pulse. The number of calculations performed per minute will therefore depend on the frequency of the pulses transmitted into the well. Typically 3-5 calculations are carried out per minute.

The electronic control unit 36 may also be programmed to store each calculated value of $V_{GAS_fr}$ and $V_{LIQ_fr}$ as a function of time, so that the changes in $V_{GAS_fr}$ and $V_{LIQ_fr}$ may be plotted graphically for viewing by an operator on a display unit associated with the electronic control unit 36. Preferably this information is displayed as it is generated so that any trends can be considered and analysed during the circulation period. This is useful to the operator to as this visually illustrates the relationship between the changing volume fractions with respect to time which could identify mistakes in the initial calculation/assumption of the influx volume. Where the influx has already been stopped, the influx will generally exhibit consistent characteristics of increasing gas volume over time as gas expands and circulates/migrates to surface—any deviation from this on the graph will alarm the operator, for example to the fact that the BHP may not have been increased sufficiently to halt the influx.

FIG. 3 shows a snapshot of the PDS pulse waveform changes measured at the return flow meter 28. $V_{ws}$ and $C_{ws}$ are derived from the increased peak amplitude of the curve as the influx is circulated up the annulus 20 and the gas breaks out of solution. As time progresses, $Q_{out}$ increases as the $V_{GAS_fr}$ increases as a result of gas expansion and gas break out occurring from the decrease in annulus pressure as it is moving up the annulus 20. This same methodology of waveform analysis can be performed with the surface pressure data WHP for each pulse.

The electronic control unit 36 uses the returning PDS pulse to determine the location of the gas in the annulus. This should be reflected by a change or shift in the period of the returning pulse and/or discontinuities in the waveform, as sonic transmission will attenuate with gas present, thus creating a longer period of time for the pulse to return to surface or transmit to the bottom of the well. This effect is well known to occur in pulse telemetry used within the drillstring, and has been shown when using bi-phasic fluid mixtures in the drill string like nitrogen and mud. The effect leads to loss of signal when the nitrogen fraction increases above a certain value. The electronic control unit 36 is therefore programmed to analyse the returning pulse signal and calculate changes in the period of the pulse to estimate where the top of the influx exists in the annulus. It is possible that eventually the attenuation will lead to loss of usable signal, but by this time, valuable data has been collected which can be used in improving the management of the bottom hole pressure during the circulation of the influx with the main choke 30, compared with conventional systems. This analysis will produce a quantitative value for $V_{ws}$ and $C_{ws}$, which can be used to calculate the $V_{GAS_fr}$ and $V_{LIQ_fr}$ at the time specific point in the circulation for the given pulse.

The electronic control unit 36 also uses each value of $V_{GAS_fr}$ to estimate the maximum pressure expected at the well head when the influx reaches the top of the wellbore ($P_{MAX_surf}$).

The electronic control unit 36 may be programmed to calculate $P_{MAX_surf}$ using Boyle's law (which states the pressure of a gas is directly proportional to its temperature and inversely proportional to its volume) or any better suited and more accurate algorithms in current use, for example the OLGA correlations.

The electronic control unit 36 will use real time data for BHP, BHT, WHP, WHT, flow rate in and out ($Q_{in}$, $Q_{out}$), and injection pressure, and all other real time drilling data available, in order to obtain real time values for the annulus compressibility with regards to fractional components of liquid, solids, and gas. The algorithm used by the electronic control unit 36 will run iterations for pressure and temperature profiling versus depth in the annulus at any given time interval assisted by real time drilling data to enhance the accuracy of the $P_{MAX_surf}$ calculation.

It should be appreciated that the invention does not depend on the exact algorithm used to calculate $P_{MAX_surf}$. The electronic control unit 36 can be programmed to use Boyle's law or any of the more complex algorithms and or correlations in current use or used in the future.

The electronic control unit 36 also uses an additional algorithm to correlate the changing $V_{GAS_fr}$ and $V_{LIQ_fr}$ to a return fluid stream composition and to relate the composition and pressure of the returning fluid to the flow characteristics of the main control valve 30 for adjusting the gain setting of the valve 30 $G_{choke}$ to a level appropriate for achieving the desired control of the BHP.

As mentioned above, the dynamic gain, or gain setting, $G_{choke}$, of a choke or control valve is the derivative or slope of the choke's flow characteristic, or the time taken for the choke to adjust the flow rate through the choke by a predetermined amount. The higher the gain setting, the more responsive the choke, i.e. little time is taken to create large changes in flow rate due to the increased response in attaining the desired choke position once the open/close signal is transmitted. The appropriate choke gain setting depends on the rate of flow of fluid into the choke and the composition of that fluid. Where the fluid flowing through the choke is a gas, the gain setting for the valve should be high due to the high pressure drop across the choke and the resulting gas expansion. Alternately stated, due to the compressibility of the gas (high value of $V_{GAS_fr}$) larger changes in choke position to achieve a small change in flow rate require a more responsive valve to accomplish, i.e. a higher gain setting. Conversely, when the fluid flowing through the choke is a liquid, the gain setting for the valve should be low, as the choke position has a more direct impact on the liquid flow due to the low compressibility of the liquid. A smaller change in the choke position achieves a large change in flow rate due to the relative incompressibility of fluid (i.e. a high value of $V_{LIQ_fr}$, requiring a less responsive valve to accomplish this, i.e. a lower gain setting.

The system will then use the values of $V_{GAS_fr}$ and $V_{LIQ_fr}$ to adjust the $G_{choke}$ of the choke 30 in real time in accordance with the changing fluid stream compositions and/or well compressibility $C_{ws}$, in order to accurately control a constant BHP as the influx circulates to surface and out of the annulus 20. This may prevent over reaction or non-reactive operation at the choke valve which could cause instability in the wellbore.

The gain setting changes the responsiveness/reactivity of the choke for attaining the required position, thus the gain setting is changed with the pressure drop changes across the choke resulting from changing return fluid stream composition. Furthermore, the gain setting can thus be correlated to increases in the gas fractional volume, its associated expansion effects in the annulus, and ultimately the total wellbore compressibility $C_{ws}$. As the influx is circulated up the annulus, the return fluid stream increases in $V_{GAS_fr}$, the pressure drop will increase across the choke valve, and the gain setting $G_{choke}$ will be increased accordingly. As the influx is circulated out and the $V_{GAS_fr}$ starts to decrease, the invention will decrease the $G_{choke}$ of the choke valve. This means less responsiveness with the choke is required due to decreasing compressibility as the $V_{LIQ_fr}$ increases (decreasing $V_{WS}$, $C_{WS}$ and $V_{GAS_fr}$), and over reactivity in acquiring the choke position is avoided. This is illustrated in FIG. 2. Both the static gain (the sensitivity of the valve to small changes in flow during steady state) and dynamic gain adjustments (sensitivity of the valve when system is in large state of flux, such as increased gas volume in the return fluid stream) will be built into the invention's algorithm.

The invention will take into account the dead band of the existing choke valve in operation in the $G_{choke}$ adjustment calculation. Thus the deadband of the valve is accounted for in the calculation resulting in an accurate value for $G_{choke}$.

Once this computation cycle has completed, the next PDS pulse is transmitted into the annulus 20 for processing.

This computation cycle is illustrated in FIG. 4.

Over time, the electronic control unit 36 analyses changes in trends and values for the $V_{WS}$ and $C_{WS}$, and their associated $V_{GAS_fr}$ and $V_{LIQ_fr}$ to calculate the bubble point pressure (where the first gas separates from the liquid in the influx) for the influx. The electronic control unit 36 performs this with successive PDS pulses and continuous analysis of WHP and flow meter waveforms for each returning pulse using programmed algorithms such as OLGA.

Referring again to FIG. 2, the relationship is shown between the volume of the initial influx $V_{influx}$, and the changing return flow rate as the influx is circulated to surface. Where the change in flow rate starts to occur is where the pressure of the influx/gas has decreased to below the bubble point pressure ($P_{BUBBLE_POINT}$) and as a result gas begins to break out of solution. From here, the increase in the flow rate out of the well is the corresponding expansion of gas after break out, and subsequent displacement of fluid from the well, increasing the volume and velocity of the fluid exiting the annulus as the gas circulates/migrates to surface.

As mentioned above, the gain setting, $G_{choke}$, is also plotted on this graph to show its changing relationship with changing return flow rates. $T_{lag}$ is the total time for the influx to be circulated from the well bottom to beneath the BOP—this is considered the time limit where either the BOP is already closed or the influx was calculated to be small enough in volume that it could be circulated through the MPD system. This illustrates how $G_{choke}$ is controlled to be related to the increasing volume of gas in the annulus as it circulates to surface, requiring a more responsive valve to deal with the expanding and higher pressure gas at surface. The increasing fractional volume of gas is represented by the increasing $V_{WS}$ and $C_{WS}$ values as gas expansion displaces drilling fluid from the well as it breaks out of solution—the total wellbore compressibility increases as a result of increased gas volume ($V_{GAS_fr}$) in the annulus.

The curves peak when the influx has reached surface, and as circulation continues the $V_{WS}$ and $C_{WS}$ values will begin to decrease as the compressibility of the system decreases due to gas exiting the annulus (decreasing $V_{GAS_fr}$). This also corresponds to a decrease in $G_{choke}$ as the required responsiveness of the valve decreases as the $P_{MAX_surf}$ and $V_{GAS_fr}$ both start to decrease.

The electronic control unit 36 is programmed to recalculate the rate of increase of $V_{WS}$ and the change in $C_{WS}$ as the gas rises with respect to time. Indirectly, these outputs of the invention determine the composition of the return fluid stream. It will also allow determining if further influx is occurring as this would show up as an error in the actual surface pressure or BHP compared to predicted/calculated values due to the change in the constant volume of the influx that has been assumed initially with the system.

The invention can be used to substantially improve drilling efficiency when using MPD in deepwater drilling operations from a floating drilling platform. Often in these applications, when there is an influx it is necessary to decide whether to continue circulating the influx up through the annulus return line and the MPD choke system (which is faster), or to revert to conventional well control procedures (closing the BOP and circulating the influx out through the choke line). If conventional well control procedures are used, it can take several hours to days to remove the influx once the BOP is closed. As time progresses, the data obtained from the calculations described above is used by the electronic control unit 36 to make this decision.

As mentioned above, the electronic control unit logs the point of a confirmed influx as time T=0. The time allotted to continually monitor the influx as it is circulated up the annulus is the lag time $T_{lag}$ from bottom to the BOP (subsea or surface), minus a safety factor $T_{sf}$ built into the lag time margin (e.g. 2 minutes), minus the time $T_{decision}$ taken for the microprocessors to carry out the calculations required to make the decision (e.g. 2 minutes) minus the time $T_{closeBOP}$ it takes to close the BOP (e.g. 45 seconds). The time remaining, time=$T_{safety}$, is the time allotted for monitoring and accurately calculating the size of the influx with the electronic control unit 36 and real time data from PDS pulses, and indirectly, the decision period for diverting flow to conventional well control equipment (i.e. the BOP) or using the existing MPD system to remove it from the annulus. In other words, $T_{safety}=T_{lag}-T_{SF}-T_{decision}-T_{closeBOP}$ is the evaluation period for size and pressure of influx before deciding to circulate through the MPD system or close the BOP, and represents the maximum time to complete the entire control sequence and place the appropriate safety measures in place to deal with the influx.

The electronic control unit 36 is programmed to create a decision tree using the outputs of calculated anticipated surface pressure $P_{MAX_surf}$. At pressures below a predetermined level, the influx can safely be circulated out through the existing MPD system. At pressures above that predetermined level, or if there is any uncertainty about the magnitude of the influx (i.e. a volume change occurrence or any other inconsistencies indicating a further influx), the BOP will be closed and the conventional well control equipment will be used to remove the influx.

This process is illustrated in FIG. 5. Once the influx is confirmed (at T=0) and the BHP is adjusted to prevent further influx, the priority during the decision tree process is to maintain the new value of BHP. The PDS pulse waveforms are continuously analysed, producing values for $V_{WS}$ and $C_{WS}$ as described above. The electronic control unit 36 then calculates the $V_{GAS_fr}$ and studies the trend—the rate of increase in $V_{GAS_fr}$ will be the indication of the size of the influx and calculates its projected magnitude on $P_{MAX_surf}$. This analysis cycle performed in conjunction with each PDS pulse transmitted repeats until there is sufficient data from the invention's output to make a competent decision on or before the time=$T_{DECISION}$ is reached. For each pulse cycle that occurs before the prime decision is made for the process, the electronic control unit 36 will adjust the gain setting, $G_{choke}$, based on its correlation to $V_{GAS_fr}$ and $V_{LIQ_fr}$ while maintaining a constant BHP. For each PDS pulse, the electronic control unit 36 will calculate the increase in gain value as $V_{GAS_fr}$ increases through the choke (i.e. the gas influx reaches the choke valve at surface)—$V_{GAS_fr}$ is calculated from PDS waveform analysis, which is a component of the $V_{WS}$ and $C_{WS}$ calculation for the pulse. Using the same sequence, as the gas exits the annulus, the electronic control unit 36 will start to decrease the gain setting, $G_{choke}$, as the $V_{GAS_fr}$ decreases through the choke. In any case, once the gain setting is calculated, an electronic signal is transmitted to the choke valves 30, 32 and their associated controller to update the gain setting before the choke operation, and hence choke position, is changed.

The two factors that govern the decision tree are the outputs for $V_{GAS_fr}$ and $P_{MAX_surf}$ calculated for each PDS pulse. The electronic control unit 36 takes the volume of the influx and its $P_{MAX_surf}$ and relates them to the safety circulating control equipment in place and their respective limits for pressure, temperature, and volume. Rapid rates of increase and abnormal or unusual data behaviour that causes uncertainty in the outputs, or values which approach the limits of the MPD surface system generate the competent decision to close the BOP (at no later than time=$T_{DECISION}$). Once the BOP is closed, after $T=T_{closeBOP}$, the influx is circulated out of the influx through the conventional well control system which is operative by $T=T_{SAFETY}$.

From this point, the influx is circulated to surface via the choke line. If the electronic control unit 36 is operable to control the choke valve in the choke line, the electronic control unit 36 may be programmed to use the data obtained from the analysis of the PDS pulses in controlling this choke valve to maintain a substantially constant BHP. Otherwise, this choke valve is operated manually.

If the electronic control unit 36 computes values of $V_{GAS_fr}$ and $P_{MAX_surf}$ that are not approaching the limits of the surface MPD system and there is no unusual behaviour in the data output, this is taken as confirmation that the pressure and volume of the influx is small enough to be safely and confidently circulated through the MPD system. A competent decision is therefore generated to avoid closing the surface or subsea BOP (at no later than time=$T_{DECISION}$), and from this point, the influx is circulated to surface while keeping BHP constant, while the electronic control unit makes adjustments to the gain value, $G_{choke}$, with output data continually received from the invention's computations from successive PDS pulses.

The influx reaches the BOP at $T=T_{LAG}-T_{SF}$.

Carrying out these measurements and calculations on such a continuous basis, should allow accurate, real time estimates of influx volume ($V_{INFLUX}$) to be calculated and input into the algorithms to give increased accuracy of influx behaviour, system compressibility changes, and anticipated surface pressures as the influx is brought to surface.

This coupled with the ability to change the choke gain setting accordingly will compensate for the changes in fluid composition, and the resultant choke reactivity for acquiring the correct choke position will be appropriate given the current gas/liquid volume fractions flowing through the valve. These continuous calculations may allow the system to be operated during circulation of an influx within the pressure and flow rate limits of the MPD or Well Control system, and this may provide a big improvement in safety compared with current practices. It also allows much better control of BHP as by knowing this data, the process can be controlled to safely depressurize the wellbore and remove the influx while keeping the BHP constant and thus avoiding further well control events of gain or loss of fluid.

This invention can be extended to further applications, and can be used with any type of flow control algorithms in all types of flow control processes. Furthermore, this invention could be extended to its installation and integration into both MPD and conventional well control systems for more accurate tracking of the behaviour of an influx as it is circulated up hole, allowing better control over BHP and enhancing safety by adjusting the choke gain in relation to changing fluid composition in the return fluid stream. The invention will add an additional safety control measure for any influx condition. This invention could be added to any conventional well control choke system by installing an auxiliary choke line and choke, running it parallel with the main choke line and connecting into the main fluid return stream up stream of the main choke.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of drilling a subterranean wellbore using a drill string comprising the steps of:

a. injecting a drilling fluid into the well bore via the drill string and removing the drilling fluid from an annular space around the drill string (the annulus) via an annulus return line in which a main control choke is provided, b. oscillating the pressure of the fluid in the annulus, the oscillation of the pressure in the annulus being achieved by oscillating the main control choke so that a degree to which the main control choke restricts a fluid flow along the annulus return line is alternately decreased and increased, c. determining a wellbore storage volume and a wellbore storage coefficient for each fluid pressure oscillation, the wellbore storage volume being a change in a measured flow rate over a time period, and the wellbore storage coefficient being the wellbore storage volume divided by a pressure change over the time period, d. using the wellbore storage volume and wellbore storage coefficient to determine the proportion by volume of gas and the proportion by volume of liquid in the annulus during that pressure oscillation, and e. controlling a gain setting of the main control choke in accordance with the proportion by volume of gas in the annulus, wherein, the main control choke has a higher gain setting when the proportion by volume of gas in the annulus is higher, the main control choke has a lower gain setting when the proportion by volume of gas in the annulus is lower, the higher gain setting allows the main control choke to adjust a flow rate by a predetermined amount in a first time, the lower gain setting allows the main control choke to adjust the flow rate by the predetermined amount in a second time, and the first time is shorter than the second time.

2. The method according to claim 1, wherein the wellbore storage volume and wellbore storage coefficient are determined by monitoring the rate of flow of fluid along the annulus return line.

3. The method according to claim 1, wherein the wellbore storage volume and wellbore storage coefficient are determined by monitoring the fluid pressure at the top of the annulus.

4. The method according to claim 1, wherein the volume percentage of gas in the annulus and the fluid pressure in the annulus are used to obtain an estimate of the maximum pressure of the gas when the gas enters the annulus return line.

5. The method according to claim 4, wherein drilling is stopped and a blowout preventer closed around the drill string if it is determined that the estimated maximum pressure of the gas when the gas enters the annulus return line exceeds a predetermined value.

6. The method according to claim 1, wherein a main control choke is provided in the annulus return line, an auxiliary choke is provided in a branch line which extends from the annulus return line upstream of the main control choke to the annulus return line downstream of the main control choke, and the oscillation of the pressure in the annulus is achieved by oscillating the auxiliary choke so that the degree to which the auxiliary choke restricts a fluid flow along the branch line is alternately decreased and increased.

7. The method according to claim 1, further including the steps of:

monitoring the fluid pressure at the bottom of the wellbore; and controlling the main control choke to maintain the fluid pressure at the bottom of the wellbore at a predetermined level.

8. The method according to claim 7, wherein the main control choke is operated to increase its restriction of a fluid flow along the annulus return line immediately after the presence of gas in the annulus is detected.

9. The method according to claim 1, wherein an estimate of the position of any gas in the annulus is determined by analysing the shift in the frequency of the returning pressure pulse compared with the frequency of the applied pressure pulse.

10. The method according to claim 1, further including the step of:

controlling a gain setting of the main control choke, wherein, a control unit calculates the gain setting based on a correlation of the proportion of volume of gas to the proportion of volume of liquid in the annulus during the pressure oscillation and, if an increase or decrease of the gain setting is required, transmits the increase or decrease of the gain setting to a controller of the main control choke which then updates the gain setting of the main control choke, the control unit calculates and transmits an increase of the gain setting to the controller of the main control choke if the proportion by volume of gas to the proportion by volume of liquid in the annulus increases though the main control choke during the pressure oscillation, and calculates and transmits a decrease of the gain setting to the controller of the main control choke if the proportion by volume of gas to the proportion by volume of liquid in the annulus decreases though the main control choke during the pressure oscillation, a higher gain setting allows the main control choke to adjust a flow rate by a predetermined amount in a first time, a lower gain setting allows the main control choke to adjust the flow rate by the predetermined amount in a second time, and the first time is shorter than the second time.

11. A method of drilling a subterranean wellbore using a drill string comprising the steps of:

injecting a drilling fluid into the well bore via the drill string and removing the drilling fluid from an annular space around the drill string (the annulus) via an annulus return line;

oscillating the pressure of the drilling fluid in the annulus by oscillating a main control choke provided in the annulus return line so that a degree to which the main control choke restricts a fluid flow along the annulus return line is alternately decreased and increased;

determining a wellbore storage volume and a wellbore storage coefficient for each fluid pressure oscillation, the wellbore storage volume being a change in a measured flow rate over a time period, and the wellbore storage coefficient being the wellbore storage volume divided by a pressure change over the time period;

using the wellbore storage volume and wellbore storage coefficient to determine the proportion by volume of gas and the proportion by volume of liquid in the annulus during that pressure oscillation; and controlling a gain setting of the main control choke in accordance with the proportion by volume of gas in the annulus, wherein, the main control choke has a higher gain setting when the proportion by volume of gas in the annulus is higher, the main control choke has a lower gain setting when the proportion by volume of gas in the annulus is lower, the higher gain setting allows the main control choke to adjust a flow rate by a predetermined amount in a first time, the lower gain setting allows the main control choke to adjust the flow rate by the predetermined amount in a second time, and the first time is shorter than the second time.

* * * * *